US006319076B1

(12) United States Patent
Gollhofer et al.

(10) Patent No.: US 6,319,076 B1
(45) Date of Patent: Nov. 20, 2001

(54) SOCKET CONTACT ELEMENT

(75) Inventors: Martin Gollhofer, Fellbach; Wolfgang Haller, Schwaikheim, both of (DE)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 09/659,724

(22) Filed: Sep. 8, 2000

Related U.S. Application Data

(63) Continuation-in-part of application No. 09/398,892, filed on Sep. 20, 1999.

(30) Foreign Application Priority Data

Sep. 30, 1998 (DE) ..... 198 44 863

(51) Int. Cl.[7] ..... H01R 4/48
(52) U.S. Cl. ..... 439/862
(58) Field of Search ..... 439/862, 851, 439/852, 856, 858, 861

(56) References Cited

U.S. PATENT DOCUMENTS

| | | | |
|---|---|---|---|
| 2,235,780 | 3/1941 | Wagstaff | 173/328 |
| 3,539,965 | 11/1970 | Morehart et al. | 339/17 |
| 3,732,529 | 5/1973 | Weisenburger | 339/192 |
| 3,894,783 | 7/1975 | Messner | 339/91 |
| 3,955,869 | 5/1976 | Licht | 339/32 |
| 4,175,821 | 11/1979 | Hunter | 339/258 |
| 4,598,972 | 7/1986 | Mullen, III et al. | 339/258 |
| 4,687,278 | 8/1987 | Grabbe et al. | 439/842 |
| 4,702,545 * | 10/1987 | Moyaert | 439/856 |
| 4,795,379 | 1/1989 | Sasaki et al. | 439/856 |
| 4,834,681 * | 5/1989 | Chaillot | 439/856 |
| 4,952,178 | 8/1990 | Beer | 439/856 |
| 4,990,110 | 2/1991 | Byrne | 439/861 |
| 5,035,658 * | 7/1991 | Berg | 439/748 |
| 5,078,622 * | 1/1992 | Hunt | 439/589 |
| 5,681,190 | 10/1997 | Childs | 439/856 |

FOREIGN PATENT DOCUMENTS

| | | |
|---|---|---|
| 2259358 | 8/1973 | (DE) . |
| 37 00 304 C2 | 7/1988 | (DE) . |
| WO 95/04388 | 7/1994 | (WO) . |
| 9504388 * | 2/1995 | (WO) . |

* cited by examiner

*Primary Examiner*—Gary Paumen
*Assistant Examiner*—Phuong Nguyen
(74) *Attorney, Agent, or Firm*—Roger C. Turner

(57) ABSTRACT

A socket contact (1) for receiving a pin contact (4) of small diameter, especially a contact pin of a PCMCIA plug. The socket contact is formed of sheet metal and has a substantially flat base (5), a spacing part (6) extending upward from the front end of the base, and a top contact part (9) extending rearward from the top of the spacing part. The spacing part has a circular hole (7) for passing the pin contact until the pin contact is pressed upward by a tongue (8) formed in the base and is pressed downward by the top contact part. To prevent bending of the spacing part when the tongue and top contact part apply a large clamping force to the pin, the spacing part is formed with support regions (40, 42) where sheet metal at opposite sides of the spacing part are bent to extend rearwardly.

7 Claims, 4 Drawing Sheets

SOCKET CONTACT ELEMENT

CROSS-REFERENCE

This is a continuation-in-part of U.S. application Ser. No. 09/398,892 filed Sep. 20, 1999, which claims priority from German application 198 44 863.5-34 filed Sep. 30, 1998.

BACKGROUND OF THE INVENTION

The present invention relates to a socket contact for receiving a pin contact having a small diameter, especially a pin contact of a PCMCIA (Personal Computer Memory Card International Association) plug. Such contact pins have a diameter of about one-quarter to one-half millimeter and the socket contact has a height and width that are only about twice as great as the pin contact diameter. Such contact elements are known in the prior art in a variety of embodiments. Commonly, rows of such contact elements are disposed in a front face of a PCMCIA plug-in card to form socket contacts at the front of the card. The socket can be plugged into a mating PCMCIA plug-in host that may be part of a computer.

To arrange the socket contacts in the PCMCIA plug-in card, outwardly opening receiving channels are formed in the latter in the region of a front face. The socket contact elements or contacts are inserted from the rear of the receiving channels. The socket contacts are positioned inside the receiving channels so a base of the socket contact always extends at the base of the receiving channel. Specifically, the receiving channel would be blocked by a socket contact base that were disposed at an angle to the receiving channel, and the introduction of a pin contact would then be made difficult or even prevented.

A socket contact of the known type is normally punched out of a large sheet of sheet metal. Both the outer contour of the socket contact and a pin-passing opening in the spacing part of the socket contact are punched out. In the punching operation, the second spacing element and the spring tongue, except for the side where they are joined to the base, are also punched out of the base. The punch part is then bent into the shape of the finished socket contact. Thus, for example, the spring tongue is bent slightly upward relative to the base so it projects into that region of the socket contact into which the pin contact element is introduced. In addition, a front spacing part is bent upward relative to the base, and a top contact part is formed by bending backward a top contact part. Finally, a retainer is bent steeply upward relative to the basic element.

Basically, the socket contact has a substantially flat horizontal base with slits forming an upwardly-inclined tongue, a spacing part extending upwardly from the front end of the base, and a top contact part extending rearwardly from the top of the spacing part. The spacing part has a hole, and the contact pin can be inserted through the hole and be clamped between the tongue and the top contact part. The spacing part is weakened by the hole, and may plastically deform if a large clamping force is applied by the tongue and top contact part to the inserted pin. Strengthening of the spacing part to prevent it from bending, would enable the socket contact to apply a large clamping force to a pin contact.

SUMMARY OF THE INVENTION

In accordance with one embodiment of the present invention, a socket contact is provided, of the type having a vertical spacing part, a base extending rearwardly from the bottom of the spacing part and having a resilient tongue, and a top contact part extending generally rearwardly from the top of the spacing part, so a pin inserted through a hole in the spacing part is clamped between the tongue and top contact part, where the spacing part is reinforced to prevent it from bending as a result of the weakening by the hole in it. Reinforcement can be achieved by providing support regions extending at least partially rearwardly from locations at opposite sides of the spacing part. The support regions strengthen opposite sides of the spacing part that lie on opposite sides of its hole, without adding to the width of the spacing part.

The support regions can be formed with peripheral regions of the spacing part drawn back at the sides of the opening. This allows the support regions to be produced in a particularly simple way during the production of the socket contact by a deep-drawing operation.

The robustness of the spacing part at the front of the socket contact, can be increased further by reinforcing elements formed as material aggregations. The material aggregations are specifically formed in those regions of the spacing element which are subject to a particularly high bending moment loading when the pin contact is clamped. The material aggregations can be formed separately or in combination with the support regions at the opening of the spacing part.

The provision of an elongated top contact whose rear end presses firmly against the pin contact, requires reinforcement of the spacing part against bending due to the large torque. The support regions at opposite sides of the spacing part avoids permanent deformation of the spacing part. The resulting elongated resilient top contact, which serves as a spring tongue similarly to the bottom spring tongue in the base, facilitates the introduction of a pin contact into the socket contact since the spring tongues are disposed both below and above the receiving channel. The socket contact is preferably formed of a copper/beryllium alloy for excellent spring and electrical conductivity properties.

The socket contact is formed by punching it out of a large metal sheet, with the socket contact having larger dimensions in the region of the front spacing part than the width of the front spacing part in the finished socket contact. During a reshaping process, the front spacing part is deformed to the dimensions of the finished socket contact, with excess material being reshaped to form the reinforcing elements or support regions of the spacing part. The reshaped punched part is bent into the shape of the finished contact. It is proposed that, during the reshaping operation, the peripheral regions of the spacing part at the sides of the opening are deep drawn backward as reinforcing elements. Material aggregations are impressed as reinforcing elements on the surface of the first spacing element.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
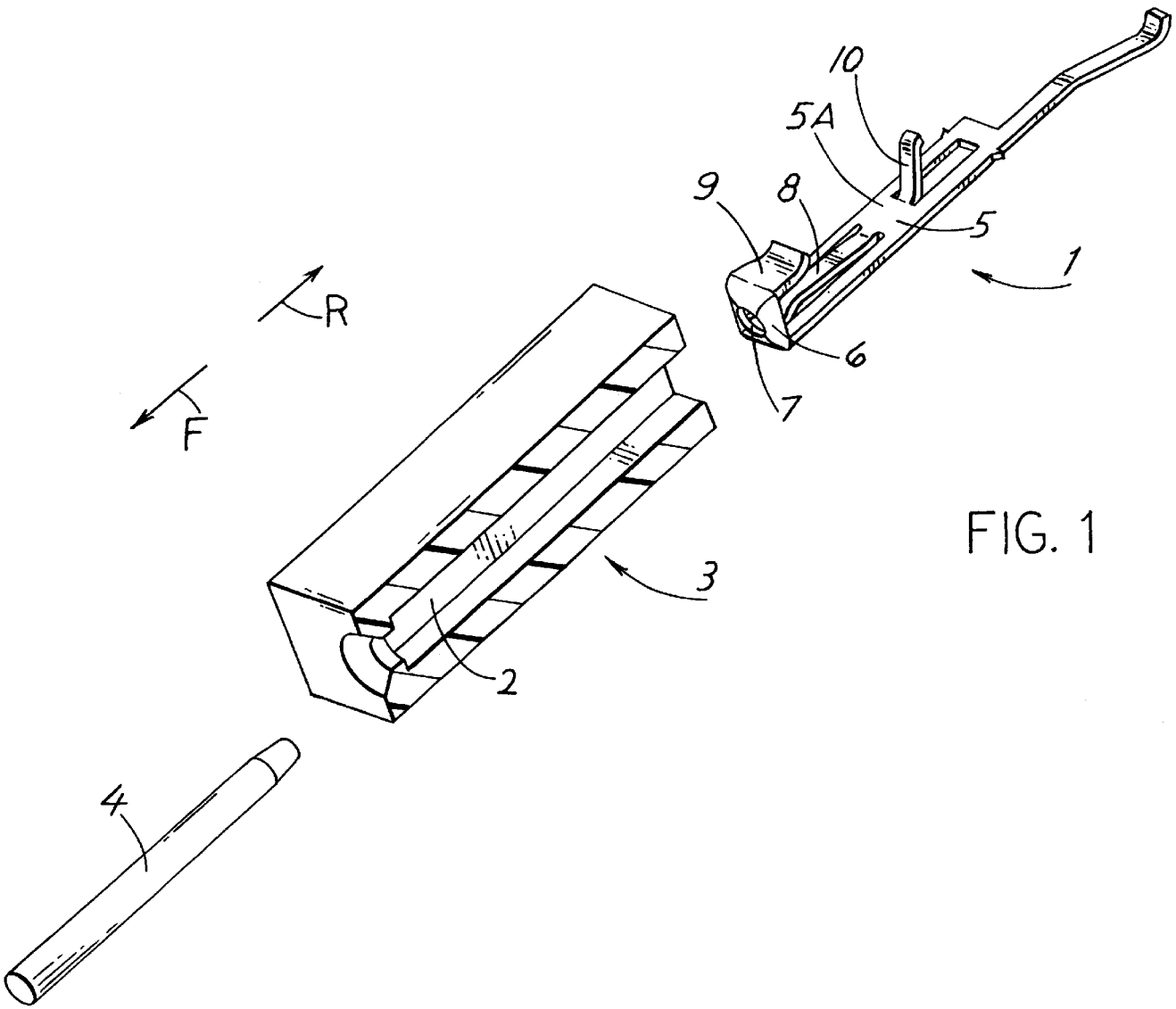
FIG. 1 is an exploded isometric view of a socket contact of a first embodiment of the invention, with a portion of a PCMCIA plug-in card and with a pin contact.
Figure 2:
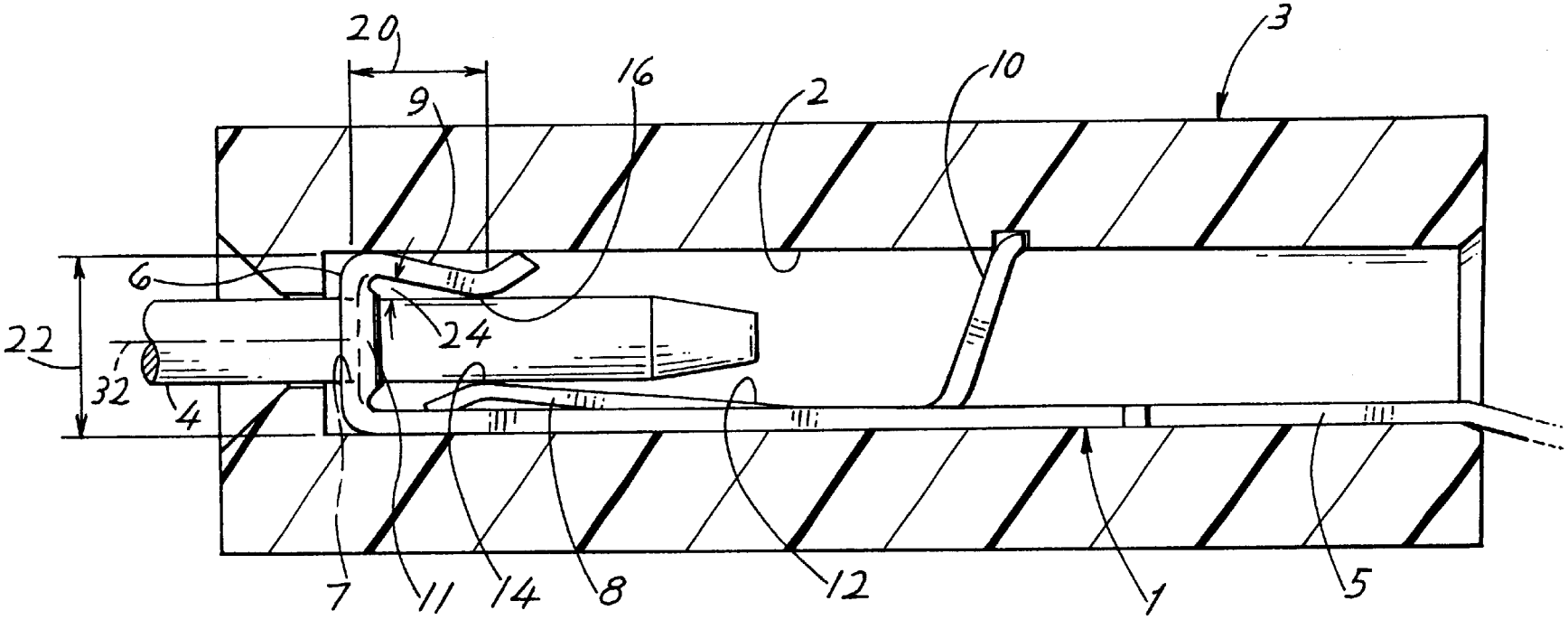
FIG. 2 is a side elevation view of the socket contact of FIG. 1 fully mated to the pin contact and with both of them lying partially in the PCMCIA plug-in card.

In FIG. 1 shows a socket contact element or socket contact 1 that can lie primarily in a receiving channel 2 of a PCMCIA plug-in card 3 shown cut away. A pin contact 4 of a PCMCIA plug element has a diameter of about 0.25 to 0.5 mm. The receiving channel 2 opens forward F at the front face of the PCMCIA plug-in card 3. The socket contact 1 is installed by pushing it forwardly into the receiving channel 2. To mate the pin contact 4, it is pushed rearward R into the socket contact 1. FIG. 2 shows the socket contact 1 fully inserted into the receiving channel 2 of the PCMCIA plug-in card 3. The pin contact 4 is likewise shown fully installed in the socket contact 1.

The socket contact 1 has an elongated base 5 with a substantially flat part 5A lying in a horizontal plane at the bottom of the contact. The base 5 is about 5.6 mm long. The front spacing part 6 extends upward from the front end of the base. The front spacing part is about 0.86 mm high and equally wide, and fits closely in the channel 2. The spacing part 6 has an opening or hole 7 for introducing the pin contact 4 into the socket contact element 1. The opening 7 has a diameter slightly more (e.g. 0.02 mm more) than the pin contact diameter. Behind the spacing part 6, a spring tongue 8 is formed in the base 5. The spring tongue 8 presses the pin contact 4 against a top contact part 9 which lies opposite, or above, the spring tongue 8. A retainer 10 extends upwards behind the spring tongue 8. The socket contact 1 is held in a defined position at the bottom of the receiving channel 2 when it is introduced into the receiving channel 2, by the spacing part 6 and retainer 10 so that a sufficiently large space is left free in the receiving channel 2 for it to be possible to introduce the pin contact element 4 without difficulty. The top contact part has a length 20 that is more than half the height 22 of the spacing part 6. The top contact part preferably extends at a downward-rearward incline angle 24 of between 5° and 30°. The length 20 times the upward force on a location 16 on the top contact equals the torque applied by the top contact part tending to bend the spacing part 6. An additional torque of the same magnitude is applied by the base 5 with its tongue 8.

The peripheral regions of the spacing part 6 which extend to the side of the opening 7 are drawn backward to form support regions 11. As a result, the spacing part 6 can better withstand a torque tending to bend its top portion forward and downward (and its lower portion upward and forward), and therefore avoid plastic deformation. This allows the spring tongue 8 and contact 9 to exert large clamping forces on the pin contact element 4, at considerable distances 20 behind the spacing part, to produce a more reliable and lower resistance electrical contact between the socket contact 1 and the pin contact 4.

Figure 3:
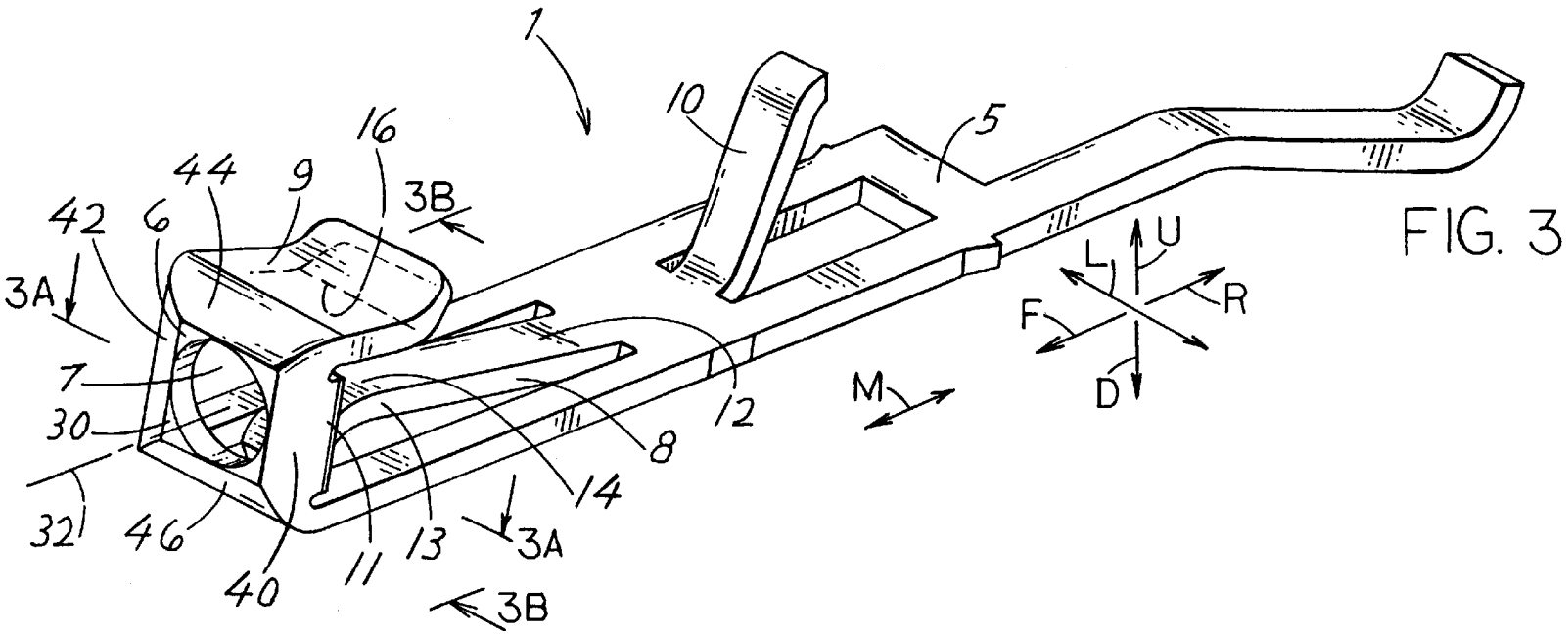
FIG. 3 is a front isometric view of the socket contact of FIGS. 1 and 2.

In the case of the socket contact 1 in FIGS. 1 to 3, the spring tongue 8 is joined at its rear end 12 to the base part 5A and extends at an upward incline. The front end 13 of the spring tongue 8 has a contact point or portion 14 that engages the socket contact 1.

FIG. 3 shows that the base is elongated in forward F and rearward R directions, which are parallel to longitudinal directions M. The spacer part 6 extends in up U and down D vertical directions between the base 5 and top contact part 9. The spacer has a square center region or portion 30 lying in a vertical plane that is normal to the axis 32 of the pin-receiving hole 7. The spacer has laterally L spaced opposite side regions 40, 42 and top and bottom regions 44, 46, where the sheet metal is drawn backward and bent so these regions are angled from the vertical plane of the square front face of the center region.

Figure 3B:
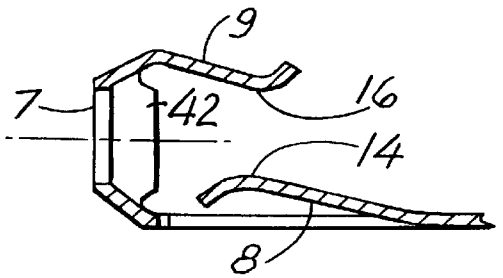
FIG. 3B is a sectional view taken on line 3B–3B of FIG. 3.
Figure 3A:
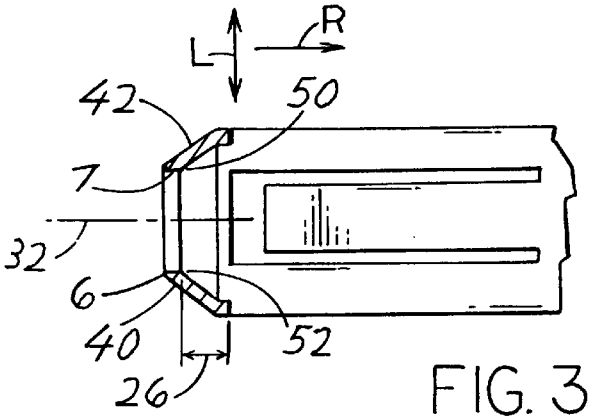
FIG. 3A is a downward sectional view taken on line 3A–3A of FIG. 3.

FIGS. 3A and 3B show details of the support regions 40, 42 that allow points 14, 16 on the tongue 8 and top contact 9 to clamp the pin contact firmly without permanent deformation of the front spacing part 6. The spacing part 6 is weakened by its large hole 7. The reinforcing or support regions 40, 42 have bends about vertical axes 50, 52 and extend partially rearwardly, that is, at an incline from both the rearward R and lateral L directions. The front of the regions 40, 42 extend away from the axis 32 and away from each other so they do not engage the inserted pin contact which is guided by the walls of the hole 7. The support regions extend rearward by a distance 26 that is more than the thickness of the sheet metal.

Figure 4:
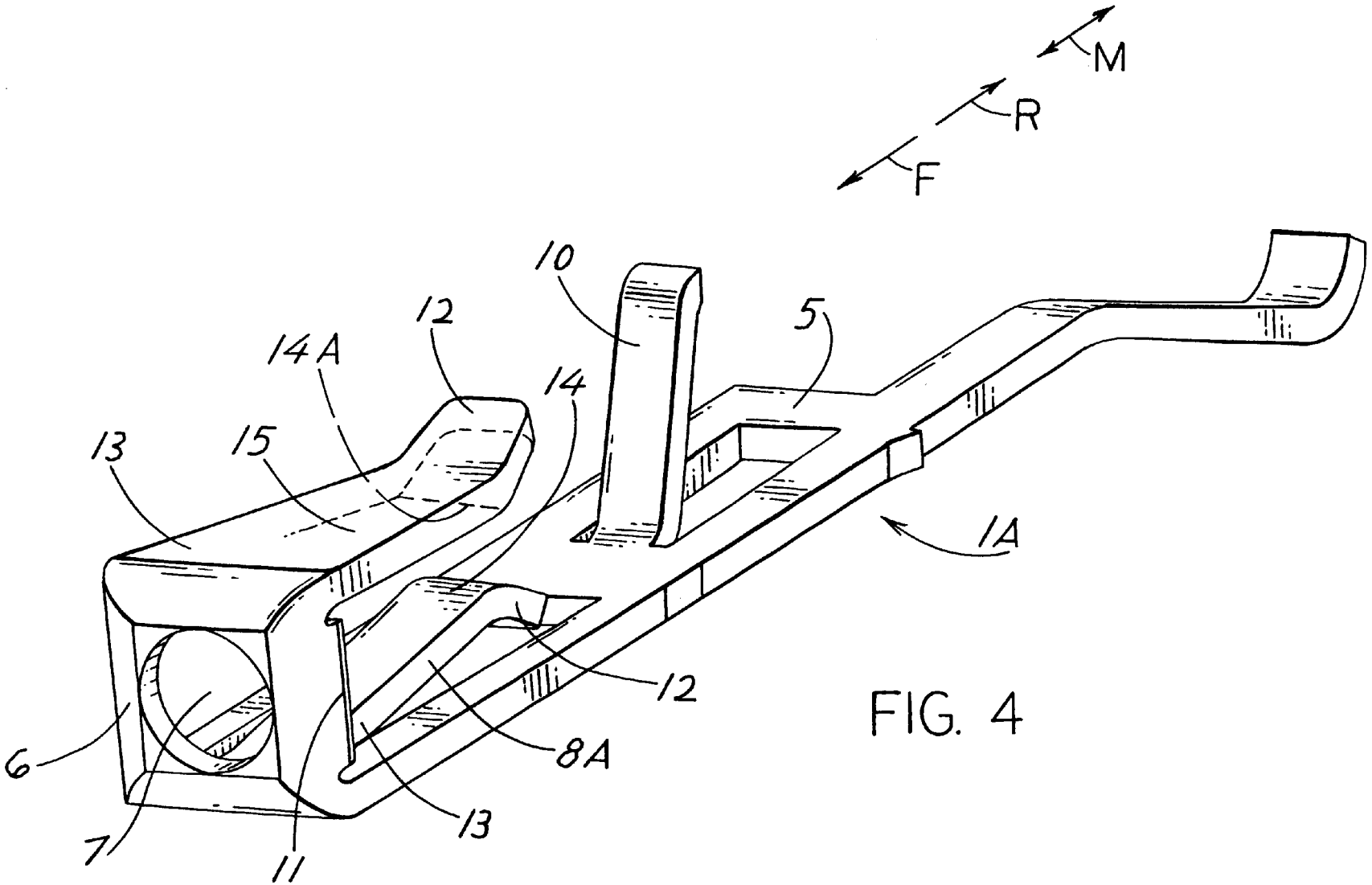
FIG. 4 is a front isometric view of a socket contact of a second embodiment of the invention.

In the case of the socket contact 14 of FIG. 4, the top contact part is formed as a longer spring top contact part 15. The spring part 15 has a contact point 14A which engages the pin contact 4 in a low resistance engagement. The top contact parts 8 and 15 of FIGS. 3 and 4 project from the top of the spacing part 6 at a small downward-rearward incline angle. This facilitates the introduction of a pin contact 4 into the socket contact element 1 by applying minimal resistance to pin insertion. Because of the special reinforcement of the spacing part 6, particularly high clamping forces can be exerted by the spring tongues 8, 8A on the inserted pin contact 4. The longitudinal M distance of the top contact part 15 between the spacing part 6 and contact point 14 is greater than the vertical V height of the spacing part. In FIG. 2 the longitudinal distance 20 is more than half the height 22 of the spacing part.

To produce the socket contact 1, it is first punched out of a metal sheet. The metal sheet is composed of a copper/beryllium alloy and is about 0.12 mm thick. Both the outer contour of the socket contact 1 and the opening 7 are punched out in the spacing part 6. In the punching operation, the retainer 10 and the spring tongue 8, except for the side with which they are joined to the base 5, are also punched out of the base 5. A plurality of socket contacts 1 are always punched out of the metal sheet in a grid of about 1.27 mm. In the region of the spacing part 6 and its support regions 40, 42, the socket contact 1 is punched out of the metal sheet with a width of 1.27 mm although the width of the spacing part 6 of the finished socket contact element 1 is only about 0.86 mm.

The punched part is then brought to the dimensions of the finished socket contact 1 in the region of the first spacing part 6 during a reshaping operation, the excess material being reshaped to form the reinforcing regions 40, 42 of the first spacing element 6. During the reshaping operation, the peripheral regions of the spacing part 6 at the side of the opening 7 are deep-drawn backwards to the rear of the reinforcing or supporting regions.

Finally, the punched part is bent into the shape of the finished socket contact 1. Thus, for example, the spring tongue 8 is bent slightly upwards relative to the base 5 so that it projects into that region of the socket contact 1 into which the pin contact 4 is introduced. In addition, the spacing part 6 is bent upwards relative to the base 5 and the top contact part 9 is formed by bending once again relative to the spacing part 6 opposite the spring element 8. Finally, the retainer 10 is bent steeply upwards relative to the base 5.

While terms such as "top", "horizontal", etc. have been used to describe the socket contact as it is illustrated, the socket contact and plug-in card that holds it, can be used in any orientation with respect to the Earth.

Thus, the invention provides a sheet metal socket contact for receiving a pin contact, which applies large clamping forces and torques to the pin contact, by a spring tongue that is formed in a base and that presses up, and a top contact part that presses down against the pin contact. The top contact part and the base extend rearwardly from a vertical spacing part that has a hole that passes the pin. The opposite sides of the spacing part beyond the hole, are strengthened by forming them as support regions that extend rearward and away from each other. The support regions are preferably along a portion of the sheet metal from which the socket contact is formed, that is initially of greater lateral width than the rest of the socket contact. The top contact part is preferably at least half as long as the height of the spacing part so the top contact part can extend at a small incline angle to allow insertion of the pin contact with low insertion force.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A socket contact for receiving a pin contact, where the socket contact includes a piece of sheet metal forming a base with a flat base part that is elongated in front and rear longitudinal directions and that has laterally spaced opposite sides and that lies in a horizontal plane and has a base part front end, a spacing part formed by a piece of said sheet metal that extends upward from said base part front end and that has a top, said spacing part having a longitudinally-extending opening for passing said pin contact and having laterally-spaced opposite sides, and a top contact part extending primarily rearward from said top of said spacing part, said base forming a tongue with a contact location lying above said base part and below said top contact part, wherein:

said spacing part has a pair of support regions that extend at least partially rearwardly and away from each other from locations at said laterally opposite sides of said spacing part, as seen in a downward sectional view taken through a middle of the height of said spacing part, to thereby strengthen said hole-forming spacing part against bending;

said hole is circular and has a width and has a longitudinally-extending axis, and said spacer has a square center portion (30) with front and rear surfaces each lying in a vertical plane that is normal to said axis and that forms said hole, with said center portion having top and bottom edges extending along the entire width of said hole;

said spacing part has a top region that extends at a rearward-upward incline from said top edge of said center portion, and has a bottom region that extends at a rearward-downward incline from said bottom edge of said center portion.

2. A socket contact for receiving a pin contact, where the socket contact includes a piece of sheet metal forming a base with a flat base part that is elongated in front and rear longitudinal directions and that has laterally spaced opposite sides and that lies in a horizontal plane and has a base part front end, a spacing part formed by a piece of said sheet metal that extends upward from said base part front end and that has a top, with said spacing part having a longitudinally-extending opening for passing said pin contact and having laterally-spaced opposite sides, and a top contact part extending primarily rearward from said top of said spacing part, said base forming a tongue with a contact location lying below said top contact part, wherein:

said spacing part has a pair of support regions that extend at least partially rearwardly and away from each other from locations at said laterally opposite sides of said spacing part, as seen in a downward sectional view taken through a middle of the height of said spacing part, to thereby strengthen said hole forming spacing part against bending;

said top contact part forming a beam that extends at a rearward-downward incline from the top of said spacing part by a distance that is at least half as great as the vertical height of said spacer part.

3. A socket contact for receiving a pin contact element, where the socket contact includes a piece of sheet metal forming a flat base that is elongated in front and rear longitudinal direction and that has laterally spaced opposite sides and that lies in a horizontal plane and has a front end, a spacing part that extends upward from said front end of said base and that has a top with said spacing part having an opening for passing said pin contact element, and a top contact part extending primarily rearwardly from said top of said spacing part, said base forming a tongue that extends at an upward incline and that has a contact location lying below said top contact part to clamp the pin contact element between them, wherein:

said top contact part forms a beam that extends at a downward and rearward incline from the top of said spacing part and that has a contact point near a rear end of said top contact, with a length of said top contact part being at least half the height of said spacing part.

4. The socket contact described in claim 3 wherein:

said spacer part has opposite sides that have bends that are bent about vertical axes and that have support regions that extend partially rearward and away from said opening from said bends.

5. A socket contact for receiving a pin contact, where the socket contact includes a piece of sheet metal forming a base with a flat base part that is elongated in front and rear longitudinal directions and that has laterally spaced opposite sides and that lies in a horizontal plane and has a base part front end, a spacing part formed by a piece of said sheet metal that extends upward from said base part front end and that has a top, with said spacing part having a longitudinally-extending opening for passing said pin contact and having laterally-spaced opposite sides, and a top contact part extending primarily rearward from said top of said spacing part, said base forming a tongue with a contact location lying above said base part and below said top contact part, wherein:

said spacing part has a pair of support regions that extend at least partially rearwardly and away from each other from locations at said laterally opposite sides of said spacing part, as seen in a downward sectional view taken through a middle of the height of said spacing part, to thereby strengthen said hole-forming spacing part against bending.

6. The contact described in claim 1 wherein:

said hole is circular and has a longitudinally-extending axis, and said spacer part has a center region with a front surface that lies in a vertical plane that is normal to said axis and with said center portion forming said hole said front surface including front surface portions lying on laterally opposite sides of said hole and front surface portions lying above and below said hole.

7. The contact described in claim 5 wherein:

said base forms a retainer, said retainer lying rearward of said tongue and extending primarily upwardly from said base to a height at least as great as a top of said spacer part.

* * * * *